US008130972B2

(12) United States Patent
Suzuki

(10) Patent No.: US 8,130,972 B2
(45) Date of Patent: Mar. 6, 2012

(54) AUDIO REPRODUCING APPARATUS AND PROGRAM

(75) Inventor: Shiro Suzuki, Kanagawa (JP)

(73) Assignee: Sony Corporation, Tokyo (JP)

( * ) Notice: Subject to any disclaimer, the term of this patent is extended or adjusted under 35 U.S.C. 154(b) by 1156 days.

(21) Appl. No.: 11/854,141

(22) Filed: Sep. 12, 2007

(65) Prior Publication Data

US 2008/0085010 A1 Apr. 10, 2008

(30) Foreign Application Priority Data

Oct. 6, 2006 (JP) ..... 2006-275074

(51) Int. Cl.
*H04R 1/10* (2006.01)

(52) U.S. Cl. ..... 381/74; 381/59; 381/96; 381/111

(58) Field of Classification Search ..... 381/59, 381/74, 94.6, 95, 96, 111–117, 122, 123
See application file for complete search history.

(56) References Cited

U.S. PATENT DOCUMENTS

| | | | | |
|---|---|---|---|---|
| 5,175,768 | A * | 12/1992 | Daniels | 381/309 |
| 5,655,025 | A * | 8/1997 | Kim et al. | 381/11 |
| 7,043,036 | B2 * | 5/2006 | Yamada et al. | 381/309 |
| 7,783,054 | B2 * | 8/2010 | Ringlstetter et al. | 381/59 |
| 2005/0147229 | A1 * | 7/2005 | King | 379/388.01 |
| 2006/0126871 | A1 * | 6/2006 | Yamada et al. | 381/309 |

FOREIGN PATENT DOCUMENTS

| | | |
|---|---|---|
| JP | 6-38396 | 5/1994 |
| JP | 6-62622 | 9/1994 |
| JP | 2004-266807 | 9/2004 |
| JP | 2009-543388 | 12/2009 |

OTHER PUBLICATIONS

Japanese Office Action issued Sep. 13, 2011, in Patent Application No. 2006-275074.

* cited by examiner

*Primary Examiner* — Vivian Chin
*Assistant Examiner* — Friedrich W Fahnert
(74) *Attorney, Agent, or Firm* — Oblon, Spivak, McClelland, Maier & Neustadt, L.L.P.

(57) ABSTRACT

A reproducing apparatus includes: a connecting part which is connected to an audio signal output apparatus through the three pole terminal; a storage part which stores content data including first and second channel audio data; a reproducing part which reproduces the content data; a first converting part which converts the first channel audio data included in the content data reproduced by the reproducing part into the first channel audio signal; a second converting part which converts the second channel audio data included in the content data reproduced by the reproducing part into the second channel audio signal; and a measuring part which measures at least any one of an amount of sound leakage in the second output unit caused by outputting the first channel audio signal and an amount of sound leakage in the first output unit caused by outputting the second channel audio signal.

9 Claims, 8 Drawing Sheets

AUDIO REPRODUCING APPARATUS AND PROGRAM

CROSS REFERENCES TO RELATED APPLICATIONS

The present invention contains subject matter related to Japanese Patent Application JP 2006-275074 filed in the Japanese Patent Office on Oct. 6, 2006, the entire contents of which being incorporated herein by reference.

BACKGROUND OF THE INVENTION

1. Field of the Invention

The present invention relates to an audio reproducing apparatus and a program.

2. Description of the Related Art

In recent years, for portable audio reproducing apparatuses widely used, a headphone using a three pole terminal is generally used. FIG. 6 shows a block diagram depicting an audio reproducing apparatus and a headphone connected thereto. First, on the headphone side, there are three terminals: an L-channel (ch) terminal, an R-channel (ch) terminal, and a ground terminal shared by the L-channel and the R-channel to which signals carried through the L-channel and the R-channel are fed back. To the L-channel terminal, a speaker part HL is connected through a resistance RXL. Moreover, to the speaker part HL, the ground terminal shared by the R-channel is connected through a resistance RYL and a resistance RCOM. To the R-channel terminal, a speaker part HR is connected through a resistance RXR. Moreover, to the speaker part HR, the ground terminal is connected through a resistance RYR and the resistance RCOM.

On the audio reproducing apparatus side, as similar to the headphone side, there are three terminals: an L-channel terminal, an R-channel terminal, and a ground terminal. In addition, there are two input sources (signal sources) of audio signals for the L-channel and the R-channel. As shown in the drawing, the output audio signals from these signal sources are supplied to the L-channel terminal and the R-channel terminal through analog amplifying parts 21*a* and 21*b*, respectively. Furthermore, for example, the ground terminal is grounded through a resistance RZC such as a ferrite bead.

In FIG. 6, a general configuration is shown in which the audio reproducing apparatus is connected to the headphone through three terminals. However, with this configuration, a problem of sound leakage arises between the L-channel and the R-channel. For example, suppose a signal L is carried through the L-channel in the case in which no signals are carried through the R-channel in silence. The flow of the signal L on the headphone side goes through the path from the L-channel terminal to the resistance RXL to the speaker part HL, a sound wave is generated in the speaker part HL, and then the sound wave reaches a connecting point X of the resistance RYL to the resistance RCOM. Since the connecting point X is also connected to the R-channel side, the signal L carries the amount of sound leakage from the connecting point X to the R-channel, which causes a sound leakage. Consequently, a sound wave occurs from the speaker part HR of the R-channel which has to be silent. In addition, even though the operations of the L-channel and the R-channel are performed reversely, a sound leakage occurs in the channel opposite to the channel through which the signal is carried.

Here, the factor that a sound leakage occurs on the R-channel side as described above is because the three terminal configuration is employed in which the L-channel and the R-channel share the ground terminal to which signals from the both channels are fed back, and because the resistance RCOM is connected to the ground terminal on the headphone side and the resistance RZC is connected to the ground terminal on the audio reproducing apparatus side. In the case in which the resistance value of the resistance RCOM is 0Ω and the resistance RZC is not connected, or the resistance value of the resistance RZC is 0Ω, even though the L-channel and the R-channel share the ground terminal, the signals carried through one channel do not cause sound leakage signals on the other channel, and are fed back to the ground terminal, causing no sound leakage. However, it is likely that the resistance RCOM is generated even though a very small amount due to the contact resistance of the ground terminal on the headphone side with the ground terminal on the audio reproducing apparatus side. In addition, the resistance RZC is used in the audio reproducing apparatus for attenuating high frequencies. Since it is likely to damage the analog amplifying parts 21*a* and 21*b* unless otherwise the resistance RZC is provided, the resistance RZC is necessary to the audio reproducing apparatus.

In order to control such sound leakage, the applicant proposed a configuration shown in FIG. 7. First, referring to FIG. 7, the ratio between signals carried through the L-channel and the R-channel and the amount of sound leakage is expressed by a sound leakage ratio 1/M. In addition, the discussion will proceed as the sound leakage ratio 1/M is equal in the L-channel and the R-channel. To the audio reproducing apparatus shown in FIG. 7, the configuration of the audio reproducing apparatus shown in FIG. 6 is added with analog amplifying parts 14*a* and 14*b* which have a gain equivalent to the sound leakage ratio 1/M for the L-channel and the R-channel.

The analog amplifying part 14*a* is connected to the connecting point of a signal source L to an analog amplifying part 13*a*, and connected to an R-channel terminal from the connecting point through the analog amplifying part 14*a*. Then, the analog amplifying part 14*b* is connected to a signal source R, and the signal source R is connected to an L-channel terminal through the analog amplifying part 14*b*. In addition, the configuration on the headphone side is the same as the configuration on the headphone side shown in FIG. 6, omitting the discussion here. In the audio reproducing apparatus in this configuration, for example, the gain of the analog amplifying part 14*a* is multiplied by the signal L carried through the L-channel, whereby a sound leakage delete signal Lc equivalent to the amount of sound leakage generated in the R-channel can be added to the R-channel terminal on the audio reproducing apparatus side in advance. With this scheme, even though the signal L is carried through the L-channel to cause an amount of sound leakage in the R-channel from the connecting point X, the sound leakage delete signal Lc that cancels it is generated in the R-terminal. Thus, the amount of sound leakage and the sound leakage delete signal Lc are cancelled to each other, a sound wave caused by sound leakage hardly occurs in the speaker part HR, and then the sound leakage can be reduced. Also in the case in which sound leakage is reduced on the L-channel side, the analog amplifying part 14*b* is used to perform the operation described above in which the L-channel and the R-channel are reversed, and then the sound leakage can be reduced.

However, the configuration of reducing the sound leakage like this has problems below. In other words, in the configuration shown in FIG. 7, since a reduction in sound leakage is implemented with the use of analog devices and circuits, the characteristics might be unstable due to variations in devices. In addition, in FIG. 7, it is essential to add a new circuit such as an analog amplifying part, the addition of the new circuit affects the overall circuit, and it is likely that the computed sound leakage ratio does not sufficiently reduce the sound leakage. In addition, the necessity of this addition increases costs for components, causing problems that the power consumption is increased by the additional device (the circuit) and the circuit scale is increased.

Then, as shown in FIG. 8, the function of the analog amplifying parts 14*a* and 14*b* in FIG. 7 is implemented by digital signal processing, whereby the sound leakage can be reduced with no additional analog devices. In other words, the product-sum operation performed in FIG. 7 is performed by digital signal processing in a D-Block 20 shown in FIG. 8, the product-sum operation in which the sound leakage delete signal (data) is added to the L-channel and the R-channel.

In the configuration of the audio reproducing apparatus shown in FIG. 8, the configuration is provided with the D-Block 20, D/A converters 19*a* and 19*b*, analog amplifying parts 15*a* and 15*b*, an L-channel terminal, a R-channel terminal, a ground terminal and a resistance RZC. First, L-channel audio data is supplied to the D-Block 20. Then, it is supplied from the D-Block 20 to the L-channel terminal through the D/A converter 19*a* and the analog amplifying part 15*a*. In addition, R-channel audio data is first supplied to the D-Block 20. Then, it is supplied from the D-Block 20 to the R-channel terminal through the D/A converter 19*b* and the analog amplifying part 15*b*. Furthermore, the ground terminal is grounded through the resistance RZC.

Then, in the D-Block 20, sound leakage reducing multipliers 16*a* and 16*b*, overflow preventing multipliers 17*a* and 17*b* and adders 18*a* and 18*b* are provided. In addition, the configuration inside the D-Block 20 is depicted by hardware for convenience. However, in practice, these functions are implemented by digital signal processing.

First, the L-channel audio data is supplied to the overflow preventing multiplier 17*a*. The overflow preventing multiplier 17*a* multiplies the L-channel audio data by the coefficient 1−1/M. This is because the sound leakage delete signal is added to the L-channel audio data to be 1+1/M, causing the risk of causing an overflow in the digital area. More specifically, the coefficient 1−1/M is multiplied in advance to make a gain one, and the gain becomes one after the sound leakage delete signal is added to the L-channel audio data, whereby an overflow is prevented. After the L-channel audio data is multiplied by the coefficient 1−1/M in the overflow preventing multiplier 17*a* as described above, the data is supplied to the adder 18*a*.

In addition, the L-channel audio data is supplied to the overflow preventing multiplier 17*a*, and is branched and supplied to the sound leakage reducing multiplier 16*b* as well. The sound leakage reducing multiplier 16*b* is equivalent to the analog amplifying part 14*a* shown in FIG. 7, which multiplies the L-channel audio data by the gain equivalent to the sound leakage ratio of the L-channel audio data, and supplies the sound leakage delete signal equivalent to the amount of sound leakage of the L-channel audio data to the adder 18*b*.

In addition, the R-channel audio data is first supplied to the overflow preventing multiplier 17*b*. In the overflow preventing multiplier 17*b*, the process for preventing an overflow is performed as similar to the overflow preventing multiplier 17*a* described above. Then, the R-channel audio data is supplied to the adder 18*b* through the overflow preventing multiplier 17*b*. In addition, the R-channel audio data is supplied to the overflow preventing multiplier 17*b*, and is branched and supplied to the sound leakage reducing multiplier 16*a* as well. The sound leakage reducing multiplier 16*a* is equivalent to the analog amplifying part 14*b* shown in FIG. 7, which multiplies the R-channel audio data by the gain equivalent to the sound leakage ratio of the R-channel audio data, and supplies the sound leakage delete signal equivalent to the amount of sound leakage of the R-channel audio data to the adder 18*a*.

Then, the adder 18*a* adds the data supplied from the overflow preventing multiplier 17*a* to the data supplied from the sound leakage reducing multiplier 16*a*, and supplies it to the D/A converter 19*a*. In addition, the adder 18*b* adds the data supplied from the overflow preventing multiplier 17*b* to the data supplied from the sound leakage reducing multiplier 16*b*, and supplies it to the D/A converter 19*b*. In addition, the configuration of the headphone part shown in FIG. 8 is the same as the configuration of the headphone part shown in FIG. 7, omitting the description.

Since the audio reproducing apparatus and the headphone part in the configuration shown in FIG. 8 allow performing the product-sum operation process in the D-Block 20 by digital processing, it is unnecessary to add the analog devices to reduce the sound leakage as shown in FIG. 7.

In the discussion so far, the case is described in which the amount of sound leakage is fixed. In the configuration shown in FIG. 8, for example, in the case in which the sound leakage ratio is changed from the time of setting, such that a user changes headphones, it is necessary to again set the coefficients 1/M and 1−1/M. However, as practical work, it is difficult that a manufacturer receives the audio reproducing apparatus and the headphone from the user to again set the sound leakage ratio.

Then, this scheme is performed in which the sound leakage ratio of each of a plurality of headphones is set in an audio reproducing apparatus in advance, and such a menu facility is provided that a user can select the sound leakage ratio suitable for headphones used by the user in the audio reproducing apparatus, whereby high versatility is provided to the audio reproducing apparatus.

Patent Reference 1: JP-UM-A-6-62622

SUMMARY OF THE INVENTION

However, in the scheme in which a plurality of the sound leakage ratios is set and the menu facility selects one of them, in the case in which such headphones are used that have a sound leakage ratio other than the sound leakage ratios of the headphones set in advance in the audio reproducing apparatus, it is difficult to reduce the sound leakage. In addition, in the case in which extension codes are connected to a headphone and the extension codes are connected to an audio reproducing apparatus, even though such a headphone is used that has a sound leakage ratio set in advance in the audio reproducing apparatus, it is unlikely to sufficiently reduce the sound leakage.

Although the menu facility is provided to the audio reproducing apparatus to allow a user to reduce the sound leakage to some extent, it is difficult that every user can sufficiently reduce the entire sound leakage from the reasons described above. In addition, even in the case in which the sound leakage ratio of a headphone used by a user is set in advance in the audio reproducing apparatus, it is necessary that the user has to be know the sound leakage ratio of the headphone for use beforehand and then the user him/herself selects and sets the sound leakage ratio of the headphone for use among the ratios set in the menu facility of the audio reproducing apparatus.

Thus, it is desirable to reduce the sound leakage in any headphones for use in audio reproducing apparatuses, and to reduce the sound leakage with no excessive operational effort on users.

An audio reproducing apparatus according to an embodiment of the invention is an audio reproducing apparatus connected to an audio signal output apparatus including a three pole terminal having an input terminal for a first channel audio signal, an input terminal for a second channel audio signal, and a ground terminal shared by the first channel audio signal and the second channel audio signal; a first output unit which is connected to the input terminal for the first channel audio signal and outputs the first channel audio signal; and a second output unit which is connected to the input terminal for the second channel audio signal and outputs the second channel audio signal, the reproducing apparatus first including: a connecting part which is connected to the audio signal output apparatus through the three pole terminal. It has a storage part which stores audio content data including first channel audio data and second channel audio data. It has a reproducing part which reproduces the content data. It has a first converting part which converts the first channel audio data included in the content data reproduced by the reproducing part into the first channel audio signal, and has a second converting part which converts the second channel audio data included in the content data reproduced by the reproducing part into the second channel audio signal. It has a measuring part which measures at least any one of an amount of sound leakage in the second output unit caused by outputting the first channel audio signal by means of the first output unit and an amount of sound leakage in the first output unit caused by outputting the second channel audio signal by means of the second output unit.

As described above, according to an embodiment of the invention, since the measuring part can measure at least any one of the amounts of sound leakage of the first channel audio signal and the second channel audio signal, the process for reducing the sound leakage can be performed based on the measured result.

As described above, according to an embodiment of the invention, since the process for reducing the sound leakage can be performed based on the amount of sound leakage actually measured, such an effort can be eliminated that a user selects the amount of sound leakage for a headphone for use or for a headphone with extension codes among a plurality of amounts of sound leakage set in advance as the manner before. In addition, as different from the case in which selection is made among the settings set in advance as the manner before, the sound leakage can be properly reduced for theoretically all the headphones (combinations of a headphone and an extension code).

DETAILED DESCRIPTION OF THE INVENTION

Hereinafter, the best mode for implementing an embodiment of the invention will be described (hereinafter, referred to as an embodiment).

Figure 1:
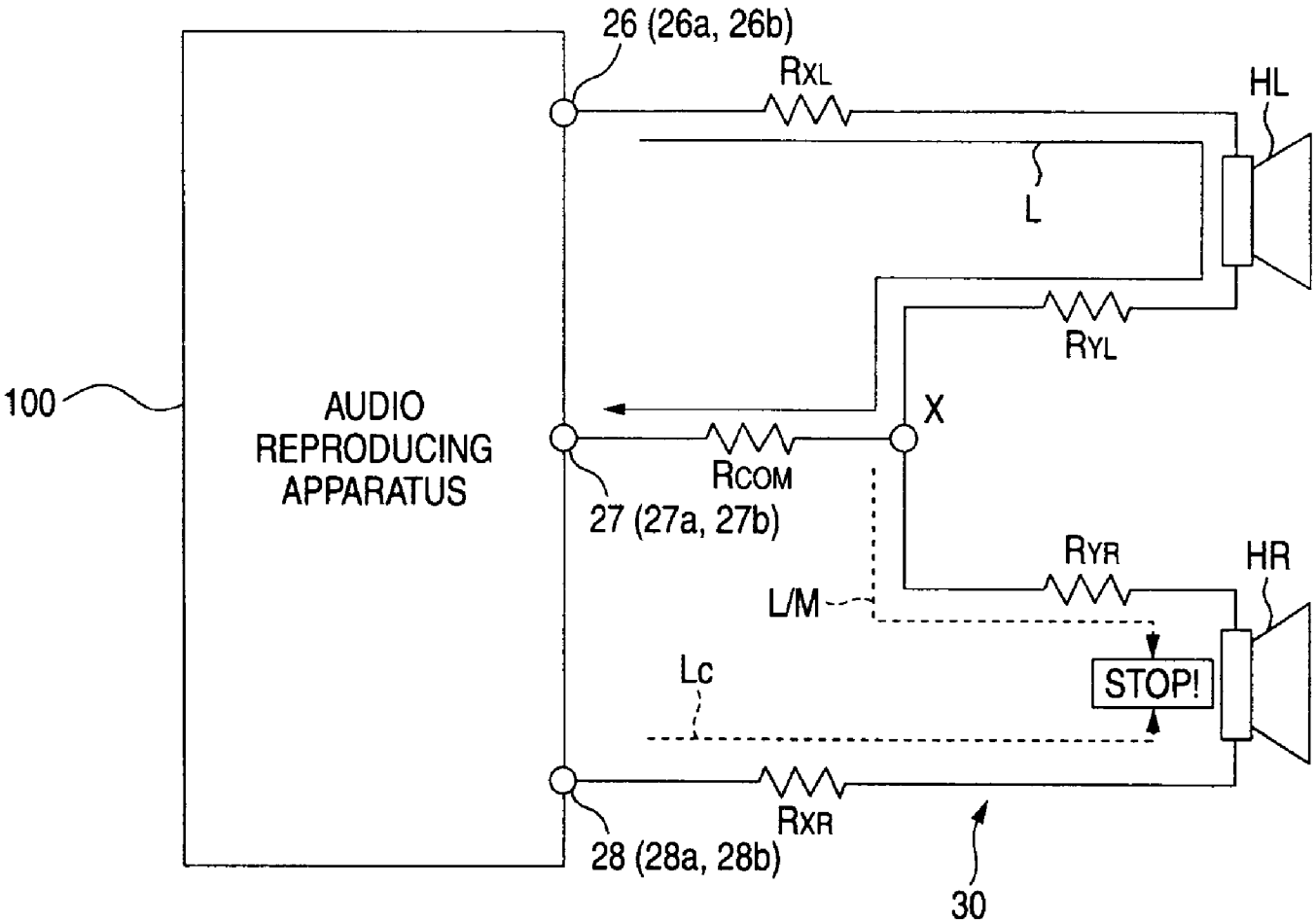
FIG. 1 shows a block diagram depicting the internal configuration of an audio reproducing system according to an embodiment of the invention.

FIG. 1 shows a block diagram depicting the internal configuration of an audio reproducing system configured to include an audio reproducing apparatus 100 and a headphone 30 connected thereto according to an embodiment of the invention. In addition, FIG. 1 mainly shows the internal configuration of the headphone 30. The headphone 30 shown in FIG. 1 is configured of three terminals: an L-channel terminal 26*b* on the headphone side, an R-channel terminal 28*b* on the headphone side, and a ground terminal 27*b* on the headphone side shared by the L-channel and the R-channel to which signals carried through the L-channel and the R-channel are fed back. To the L-channel terminal 26*b* on the headphone side, a speaker part HL is connected through a resistance RXL. Moreover, to the speaker part HL, the ground terminal 27*b* on the headphone side is connected through a resistance RYL and a resistance RCOM. To the R-channel terminal 28*b* on the headphone side, a speaker part HR is connected through a resistance RXR. Moreover, to the speaker part HR, the ground terminal 27*b* on the headphone side is connected through a resistance RYR and the resistance RCOM. In addition, on the audio reproducing apparatus 100 side, there are three terminals: an L-channel terminal 26*a* on the audio reproducing apparatus side, an R-channel terminal 28*a* on the audio reproducing apparatus side, and a ground terminal 27*a* on the audio reproducing apparatus side, which can be connected to the headphone 30.

Figure 2:
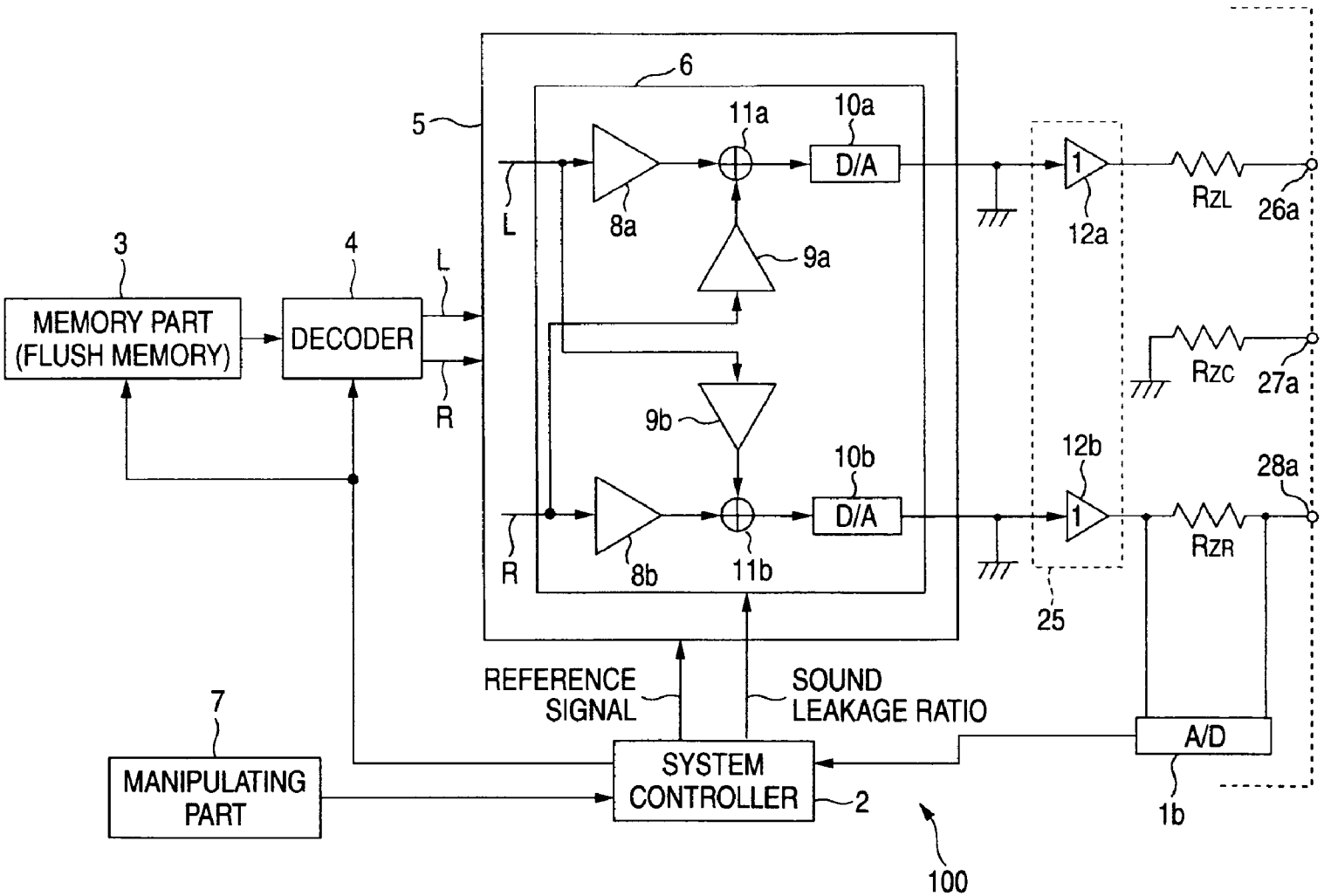
FIG. 2 shows a block diagram depicting the internal configuration of one channel of the audio reproducing apparatus according to the embodiment.

FIG. 2 shows a block diagram depicting the internal configuration of the audio reproducing apparatus 100 shown in FIG. 1. As shown in the drawing, the audio reproducing apparatus 100 has an A/D converter 1*b*, a system controller 2, a memory part (flash memory) 3, a decoder 4, a DSP (Digital Signal Processor) 5, a manipulating part 7, an amplifying part 25, the L-channel terminal 26*a* on the audio reproducing apparatus side, the ground terminal 27*a* on the audio reproducing apparatus side, the R-channel terminal 28*a* on the audio reproducing apparatus side, a resistance RZL, a resistance RZC, and a resistance RZR.

The memory part 3 is a rewritable nonvolatile memory such as a flash memory that can hold stored data even though power supply of the system is stopped. In the case of the embodiment, in the memory part 3, compressed audio data is stored that is compressed according to a predetermined audio compression mode. Based on the instruction from the system controller 2, the memory part 3 reads compressed audio data, and supplies the read compressed audio data to the decoder 4.

The decoder 4 decompresses the compressed audio data supplied from the memory part 3. Furthermore, it subjects data after decompressed to a predetermined demodulation process, and decodes it up to reproduced data. The L-channel audio data and the R-channel audio data obtained by decompression and demodulation processes are supplied to the DSP 5.

The DSP 5 subjects audio data to various ways of audio signal processing. The DSP 5 has a D-Block 6 therein which performs amplification and D/A conversion for the L-channel audio data and the R-channel audio data.

The D-Block 6 has therein overflow preventing multipliers 8*a* and 8*b*, sound leakage reducing multipliers 9*a* and 9*b*, D/A converters 10*a* and 10*b* and adders 11*a* and 11*b*. The L-channel audio data is amplified in the overflow preventing multiplier 8*a*, and supplied to the D/A converter 10*a* through the adder 11*a*. The L-channel audio signal subjected to analog conversion in the D/A converter 10*a* is supplied to the analog amplifier 12*a* in the amplifying part 25. In addition, the R-channel audio data is amplified in the overflow preventing multiplier 8*b*, and supplied to the D/A converter 10*b* through the adder 11*b*. The R-channel audio signal subjected to analog conversion in the D/A converter 10*b* is supplied to the analog amplifier 12*b* in the amplifying part 25.

In addition, as shown in the drawing, the L-channel audio data supplied to the overflow preventing multiplier 8*a* is branched and supplied to the sound leakage reducing multiplier 9*b* as well. Furthermore, the R-channel audio data supplied to the overflow preventing multiplier 8*b* is branched and supplied to the sound leakage reducing multiplier 9*a* as well. The sound leakage reducing multiplier 9*a* multiplies the R-channel audio data by the gain in accordance with the sound leakage ratio 1/M of an R-channel reference signal (data), described later, and supplies to the adder 11*a* the sound leakage delete signal (data) equivalent to the amount of sound leakage for the L-channel when the R-channel reference signal is carried. Then, the sound leakage reducing multiplier 9*b* multiplies the L-channel audio data by the gain in accordance with the sound leakage ratio 1/M of an L-channel reference signal, described later, and supplies to the adder 11*a* the sound leakage delete signal (data) equivalent to the amount of sound leakage for the R-channel when the L-channel reference signal is carried.

In addition, the overflow preventing multipliers 8*a* and 8*b* multiply audio data of each of the L-channel and the R-channel by a coefficient 1−1/M, described later, so as not to cause an overflow in the digital area. In other words, since audio data of each of the L-channel and the R-channel is added with the sound leakage delete signal for canceling the amount of sound leakage to be 1+1/M, there is the risk of causing an overflow in the digital area. When the coefficient 1−1/M is multiplied in advance, an overflow can be prevented since the gain becomes one after audio data of each of the L-channel and the R-channel is added with the sound leakage delete signal.

In the discussion here, the function of the D-Block 6 is depicted by hardware for convenience. However, in practice, various functions described above are implemented by digital signal processing.

In the amplifying part 25, the analog amplifier 12*a* and the analog amplifier 12*b* amplify and output the L channel audio signal and the R-channel audio signal, respectively. The amplified L-channel audio signal is supplied to the L-channel terminal 26*a* on the audio reproducing apparatus side through the resistance RZL, and the R-channel audio signal is supplied to the R-channel terminal 28*a* on the audio reproducing apparatus side through the resistance RZR.

Here, the audio signals of the L-channel and the R-channel carried through the headphone 30 shown in FIG. 1 are fed back to the ground terminal 27*b* on the headphone side shared by the L-channel and the R-channel. Then, the signals are supplied from the ground terminal 27*b* on the headphone side to the ground terminal 27*a* on the audio reproducing apparatus side shown in FIG. 2. Between the ground terminal 27*a* on the audio reproducing apparatus side and the ground, the resistance RZC such as a ferrite bead is connected.

For example, the system controller 2 is configured of a microcomputer having a CPU (Central Processing Unit), a ROM (Read Only Memory), and RAM (Random Access Memory), which controls the overall audio reproducing apparatus 100. In the ROM, constants and fix information used for an operating program and various processes are stored. The RAM is used for the work area and the load area for programs or used to temporarily store information. For example, the system controller 2 allows the memory part 3 to read various items of data based on the manipulating input from the manipulating part 7, described later. In addition, it allows the DSP 5 to perform audio signal processing such as volume adjustment based on the manipulating input from the manipulating part 7. In addition, particularly, in the case of the embodiment, the process for reducing the sound leakage is performed as well, which will be described later.

The manipulating part 7 is an input device by an operator, not shown, through which a user performs various manipulating inputs and data inputs. Information inputted from the manipulating part 7 is transmitted to the system controller 2 as input information for operation or data. The system controller 2 performs processes based on the input information. For example, the manipulating part 7 has an operator for volume adjustment. In addition, particularly, in the case of the embodiment, for the operator provided in the manipulating part 7, an automatic regulation switch is provided which instructs the start of the process for reducing the sound leakage.

Figure 6:
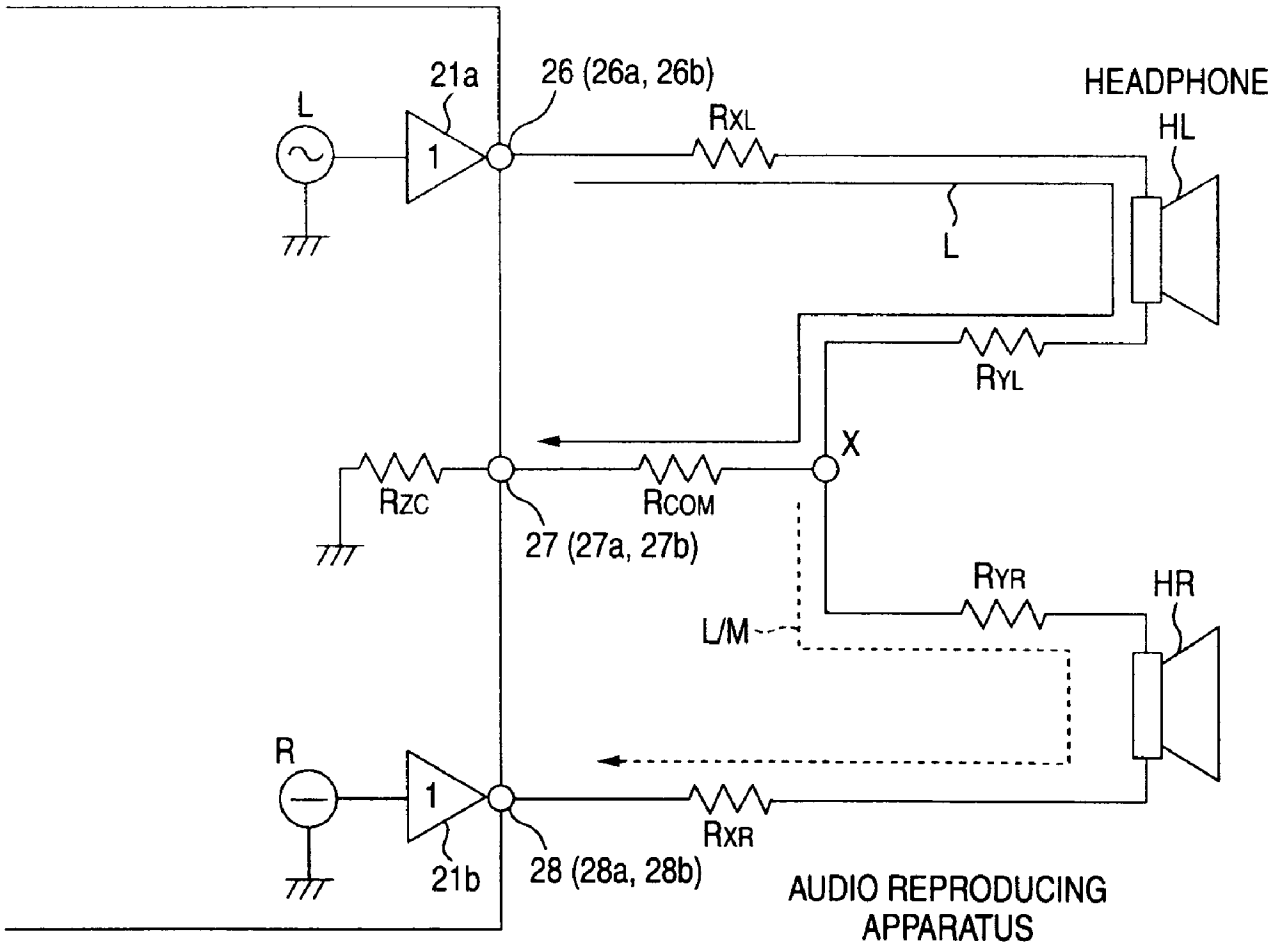
FIG. 6 shows a block diagram depicting the internal configuration of an exemplary audio reproducing apparatus and a headphone before.
Figure 7:
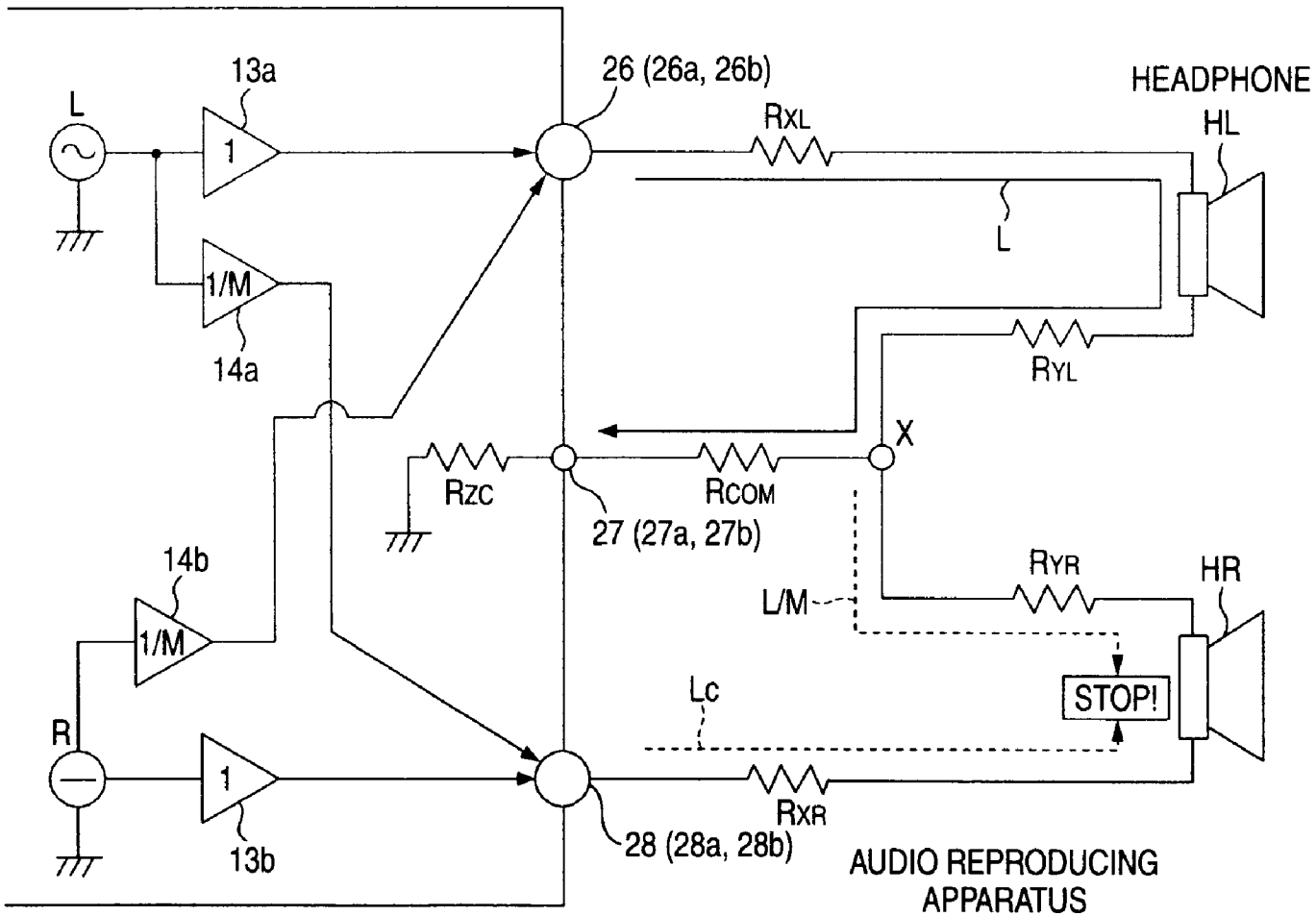
FIG. 7 shows a block diagram depicting the internal configuration of another exemplary audio reproducing apparatus and a headphone before.
Figure 8:
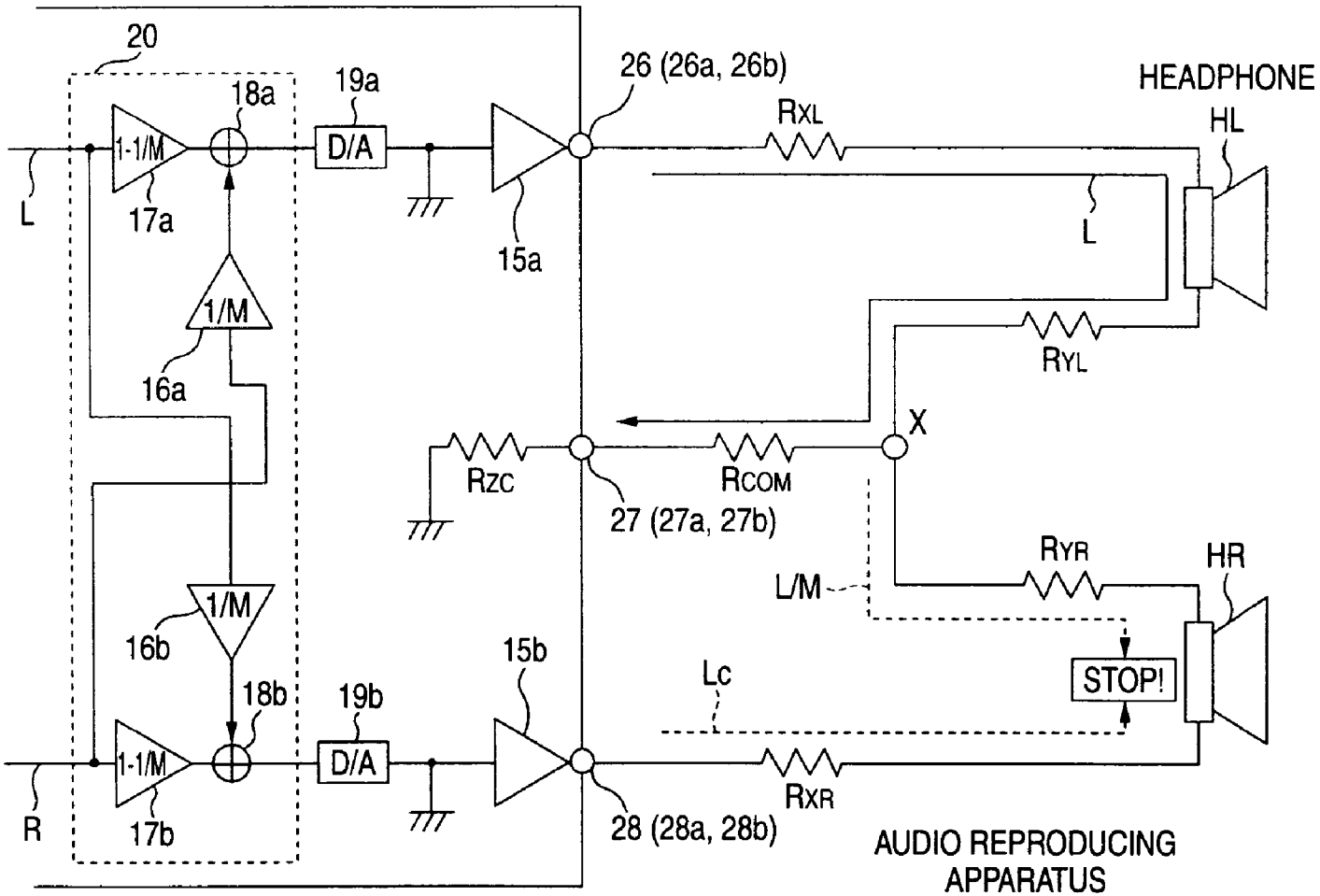
FIG. 8 shows a block diagram depicting the internal configuration of still another exemplary audio reproducing apparatus and a headphone before.

Here, depending on the audio reproducing apparatus 100 and the headphone 30 described so far, the form of the three terminal connection is adopted, in which the L-channel and the R-channel share the ground terminal and the resistance RCOM is connected thereto. Furthermore, the resistance RZC is connected between the ground terminal 27*a* on the audio reproducing apparatus side and the ground. Thus, a sound leakage occurs in the headphone 30 as similar to the description in FIG. 6.

Then, in the audio reproducing apparatus 100 according to the embodiment, in order to reduce the sound leakage, a module is first provided which measures the amount of sound leakage that actually occurs. More specifically, the A/D converter 1*b* is provided. The A/D converter 1*b* is disposed so as to measure voltages at both ends of the resistance RZR. For example, when signals are carried through the L-channel, the voltage that is caused in the resistance RZR by the sound leakage signal generated in the R-channel can be measured as an amount of sound leakage.

Based on the amount of sound leakage thus measured, the audio reproducing apparatus 100 operates for reducing the sound leakage. Hereinafter, the operation of reducing the sound leakage in the audio reproducing apparatus 100 will be described. In addition, in the discussion below, the operation in which the reference signal (data) is carried only through the L-channel will be described. In addition, for the A/D converter which measures the sound leakage, suppose only the A/D converter 1*b* is provided.

First, the operation of reducing the sound leakage is started by manipulating the automatic regulation switch by a user in the manipulating part 7. This input information is sent to the system controller 2.

Based on the input information, for example, the system controller 2 supplies 1 kHz of a sinusoidal wave signal (data) stored in the memory such as the ROM incorporated therein as the L-channel reference signal to the DSP 5, and instructs it to output the signal to the L-channel.

In the DSP 5, the L-channel reference signal is subjected to analog conversion by the D/A converter 10*a*, and supplied to the analog amplifier 12*a* in the amplifying part 25. Then, it is supplied from the analog amplifier 12*a* to the L-channel terminal 26*a* on the audio reproducing apparatus side through the resistance RZL.

Then, the L-channel reference signal is carried through the L-channel of the headphone 30 shown in FIG. 1 to cause a sound leakage signal L/M in the R-channel. The A/D converter 1*b* measures the voltage that is occurred in the resistance RZR by the sound leakage signal L/M to the R-channel as an amount of sound leakage. The amount of sound leakage is supplied to the system controller 2.

The system controller 2 computes the sound leakage ratio 1/M from the amount of sound leakage and the L-channel reference signal. Then, the gain in accordance with the sound leakage ratio 1/M is set to the sound leakage reducing multiplier 9*b* in the D-Block 6. As described above, the gain in accordance with the sound leakage ratio 1/M is set to the sound leakage reducing multiplier 9*b*, whereby the R-channel audio data is added with the R-channel sound leakage delete signal Lc equivalent to the sound leakage signal to the R-channel which is computed by multiplying the L-channel audio data by the gain set in the sound leakage reducing multiplier 9*b* in the adder 11*b*, when the reproduced audio data is carried. Then, the R-channel audio signal to which the R-channel sound leakage delete signal Lc is added is carried through the R-channel of the headphone 30 shown in FIG. 1, whereby the R-channel audio signal and the sound leakage signal L/M to the R-channel are cancelled to each other, and the sound leakage can be reduced.

In addition, the system controller 2 sets the gain in accordance with the coefficient 1−1/M to the overflow preventing multiplier 8*b*. As described above, the gain in accordance with the coefficient 1−1/M is set to the overflow preventing multiplier 8*b*, whereby it is intended to prevent an overflow as described above.

As discussed so far, the operation of reducing the sound leakage is performed in the audio reproducing apparatus 100 according to the embodiment, whereby the sound leakage can be reduced.

Next, in order to implement the operation of reducing the sound leakage performed in the audio reproducing apparatus 100, an exemplary process done by the system controller 2 will be described with reference to a flow chart shown in FIG. 3. In addition, the process shown in FIG. 3 is performed by the system controller 2 based on the program stored in the memory such as the ROM incorporated therein.

Figure 3:
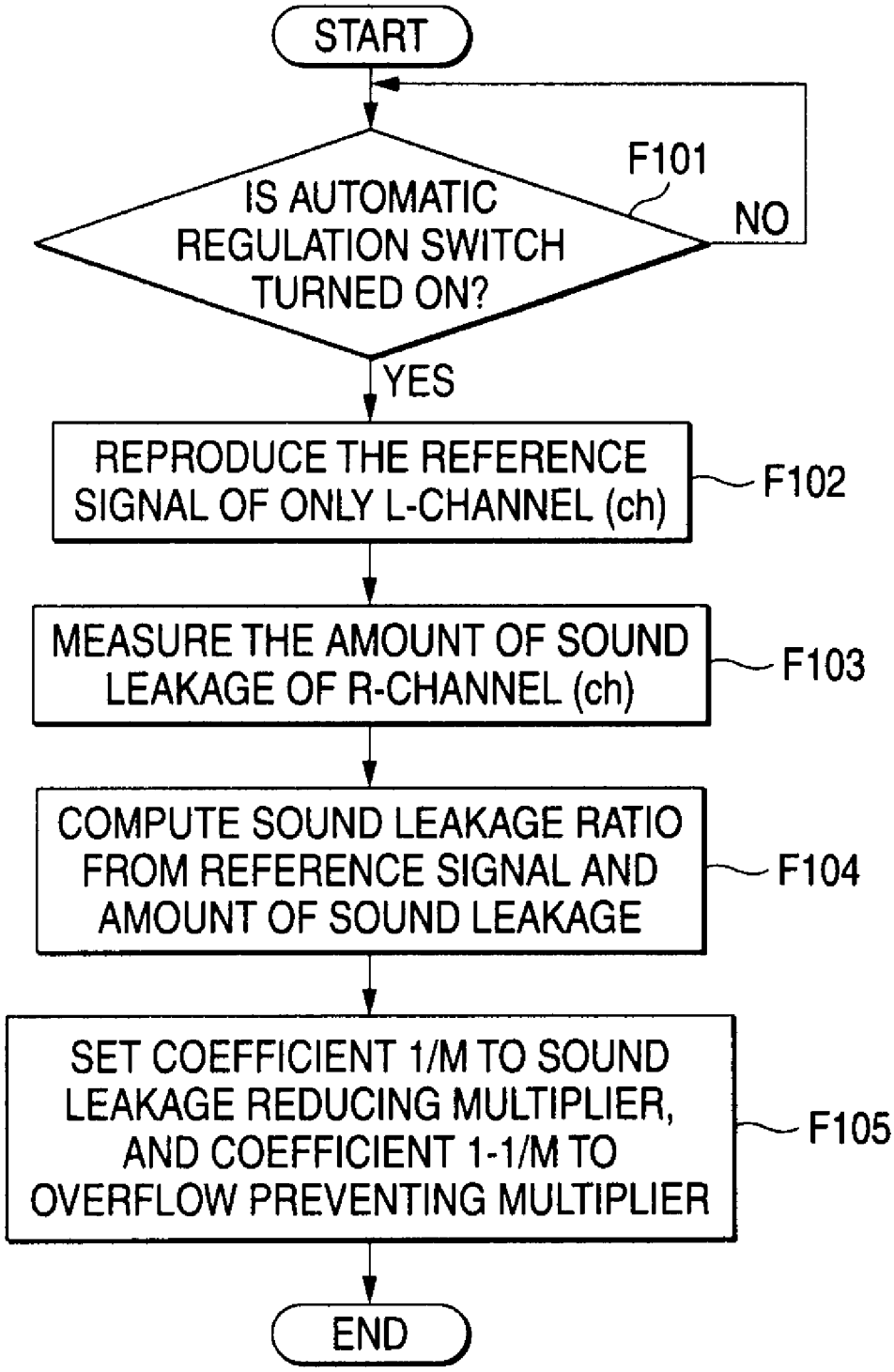
FIG. 3 shows a flow chart depicting the process operation for implementing the operation as an embodiment.

Referring to FIG. 3, first in Step F101, the manipulation of turning on the automatic regulation switch is monitored. If it is determined that a manipulating input is made in the automatic regulation switch of the manipulating part 7, the process goes to Step F102.

In Step F102, the reference signal reproducing process is performed only for the L-channel. More specifically, for example, to the DSP 5, 1 kHz of a sinusoidal wave signal stored in the system controller 2 is supplied as the reference signal for measuring the amount of sound leakage only in the L-channel, and the DSP 5 is instructed to output it.

In the subsequent Step F103, an amount of sound leakage in the R-channel is measured. In other words, in accordance with the output of the L-channel reference signal supplied to the DSP 5 in Step F102, the voltage is generated in the resistance RZR in accordance with the sound leakage signal of the R-channel, and it is measured by the A/D converter 1*b* as the amount of sound leakage, and the process of acquiring the measured value is performed.

Then, in Step F104, the sound leakage ratio is computed from the reference signal and the amount of sound leakage. In other words, the sound leakage ratio 1/M is computed from the L-channel reference signal supplied to the DSP 5 in Step F102 and the amount of sound leakage in the R-channel acquired from the A/D converter 1*b* in Step F103.

Then, in Step F105, the coefficient 1/M is set to the sound leakage reducing multiplier, and the coefficient 1−1/M is set to the overflow preventing multiplier. More specifically, the gain in accordance with the sound leakage ratio 1/M computed in Step F104 is set to the sound leakage reducing multiplier 9*b* as well as the gain in accordance with the coefficient 1−1/M is set to the overflow preventing multiplier 8*b*.

Figure 4:
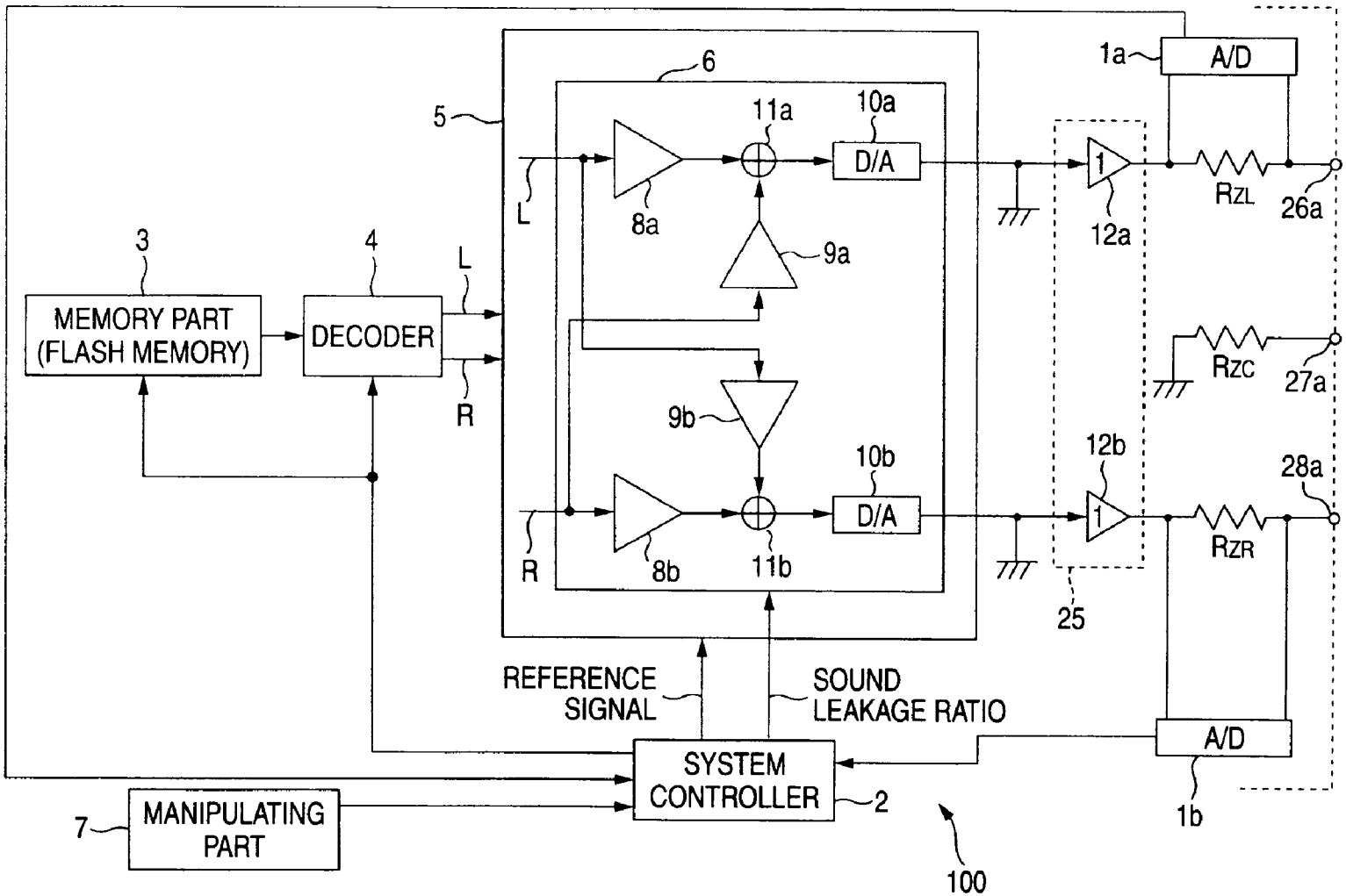
FIG. 4 shows a block diagram depicting the internal configuration of an audio reproducing apparatus according to the embodiment.

Heretofore, for convenience of description, an example is taken and described in which signals are carried only through the L-channel to reduce the sound leakage caused in the R-channel. Generally, since sounds are outputted from the L-channel and the R-channel, it is demanded to reduce the sound leakage in the L-channel as well as in the R-channel. FIG. 4 shows the configuration in which the sound leakage can be reduced in both channels as described above. In addition, in the discussion below, the sound leakage ratio is also 1/M when signals are carried through the R-channel.

An audio reproducing apparatus 100 shown in FIG. 4 has the configuration in which an A/D converter 1*a* is added to the audio reproducing apparatus 100 shown in FIG. 2, and the other configurations are the same. The A/D converter 1*a* is provided so as to measure the voltage generated in the resistance RZL.

For the operation of reducing the sound leakage in the L-channel and the R-channel, first, the setting of the coefficient (gain) for reducing the sound leakage signal to the R-channel when signals is carried through the L-channel will be performed as similar to the description above. Then, the process of reducing the sound leakage in the R-channel is performed. For the operation of reducing the sound leakage on the R-channel side, the sound leakage signal is measured that occurs in the L-channel by carrying the reference signal through the R-channel of the headphone 30 shown in FIG. 1. In other words, the sound leakage signal to the L-channel causes a voltage in the resistance RZL, and the A/D converter 1*a* measures it as an amount of sound leakage. The measured amount of sound leakage is supplied to the system controller 2.

The system controller 2 computes the sound leakage ratio 1/M from the amount of sound leakage and the R-channel reference signal. The gain in accordance with the sound leakage ratio 1/M is set to the sound leakage reducing multiplier 9*a* in the D-Block 6. As described above, the gain in accordance with the sound leakage ratio 1/M is set to the sound leakage reducing multiplier 9*a*, whereby the L-channel audio data is added with the L-channel sound leakage delete signal equivalent to the sound leakage signal to the L-channel that is computed by multiplying the R-channel audio data by the gain set to the sound leakage reducing multiplier 9*a* in the adder 11*a* when the reproduced audio data is carried. Then, the L-channel audio signal added with the L-channel sound leakage delete signal is carried through the L-channel of the headphone 30 shown in FIG. 1, whereby the L-channel audio signal and the sound leakage signal to the L-channel are cancelled to each other, and the sound leakage in the R-channel can be reduced.

In addition, the system controller 2 sets the gain in accordance with the coefficient 1−1/M to the overflow preventing multiplier 8*a*. As described above, the gain in accordance with the coefficient 1−1/M is set to the overflow preventing multiplier 8*a*, whereby it is intended to prevent an overflow as described above.

In addition, for the process done by the system controller 2 in the case in which the sound leakages in both channels are reduced, the process in FIG. 3 is first performed to set the coefficient for the L-channel. After that, it is sufficient that the same process as shown in FIG. 3 is performed on the R-channel side. More specifically, for the process of setting the coefficient for the R-channel, the reference signal only for the R-channel is first supplied to the DSP 5. Then, the A/D converter 1*a* measures the sound leakage signal in the L-channel that is caused in the resistance RZL by carrying the reference signal only through the R-channel. In addition, the sound leakage ratio 1/M is computed from the amount of sound leakage acquired from the A/D converter 1*a* and the reference signal only for the R-channel. Furthermore, the gain in accordance with the sound leakage ratio 1/M is set to the sound leakage reducing multiplier 9*a*, and the gain in accordance with the coefficient 1−1/M is set to the overflow preventing multiplier 8*a*.

As the discussion above, in the embodiment, the signals are carried through the L-channel as well as the R-channel, whereby the amounts of sound leakage can be measured that actually occur in the L-channel and the R-channel. Then, the sound leakage ratios are computed from the measured amounts of sound leakage, and set to the individual multipliers. In the process operation of reducing the sound leakage in the embodiment, a user instructs starting the process by the manipulating part 7, and then the process is performed automatically. Then, the sound leakage delete signal equivalent to the measured amount of sound leakage is added to the signal of each of the L-channel and the R-channel, and it is carried though each of the L-channel and the R-channel, whereby the amount of sound leakage and the sound leakage delete signal are cancelled to each other, and the sound leakage can be reduced. In other words, the sound leakage can be properly reduced in any headphones, and the sound leakage can be properly reduced even though extension codes are used. Therefore, such an effort can be eliminated that a user selects a sound leakage ratio of a headphone for use or of a headphone using extension codes among a plurality of set sound leakage ratios.

In addition, also in the embodiment, since the product-sum operation process can be performed in the D-Block 6 by digital processing in performing the process for reducing the sound leakage, it is unnecessary to newly add a device such as an analog amplifying part. Accordingly, such problems can be eliminated that an additional analog device increases costs for components, the power consumption for the additional device (the circuit) is increased, and the circuit scale is increased.

As described above, an embodiment of the invention has been described, but an embodiment of the invention is not restricted to the specific examples described so far. For example, in the embodiment, an example is shown in which the audio reproducing apparatus 100 is an apparatus exclusively used for reproduction, but the apparatus can be configured to be recordable. In the case of a recordable apparatus, an external input terminal is provided, and input audio signals from the input terminal can be recorded in the memory part 3. Then, in this case, an A/D converter is provided which subjects audio signals from the input terminal to A/D conversion.

Here, as understood from the discussions above, in the embodiment, it is necessary to provide the A/D converter which measures the sound leakage, but the apparatus may be a recordable apparatus as described above. In the case in which an A/D converter for recording is originally provided, the A/D converter may be shared as the device for measuring the sound leakage.

Figure 5:
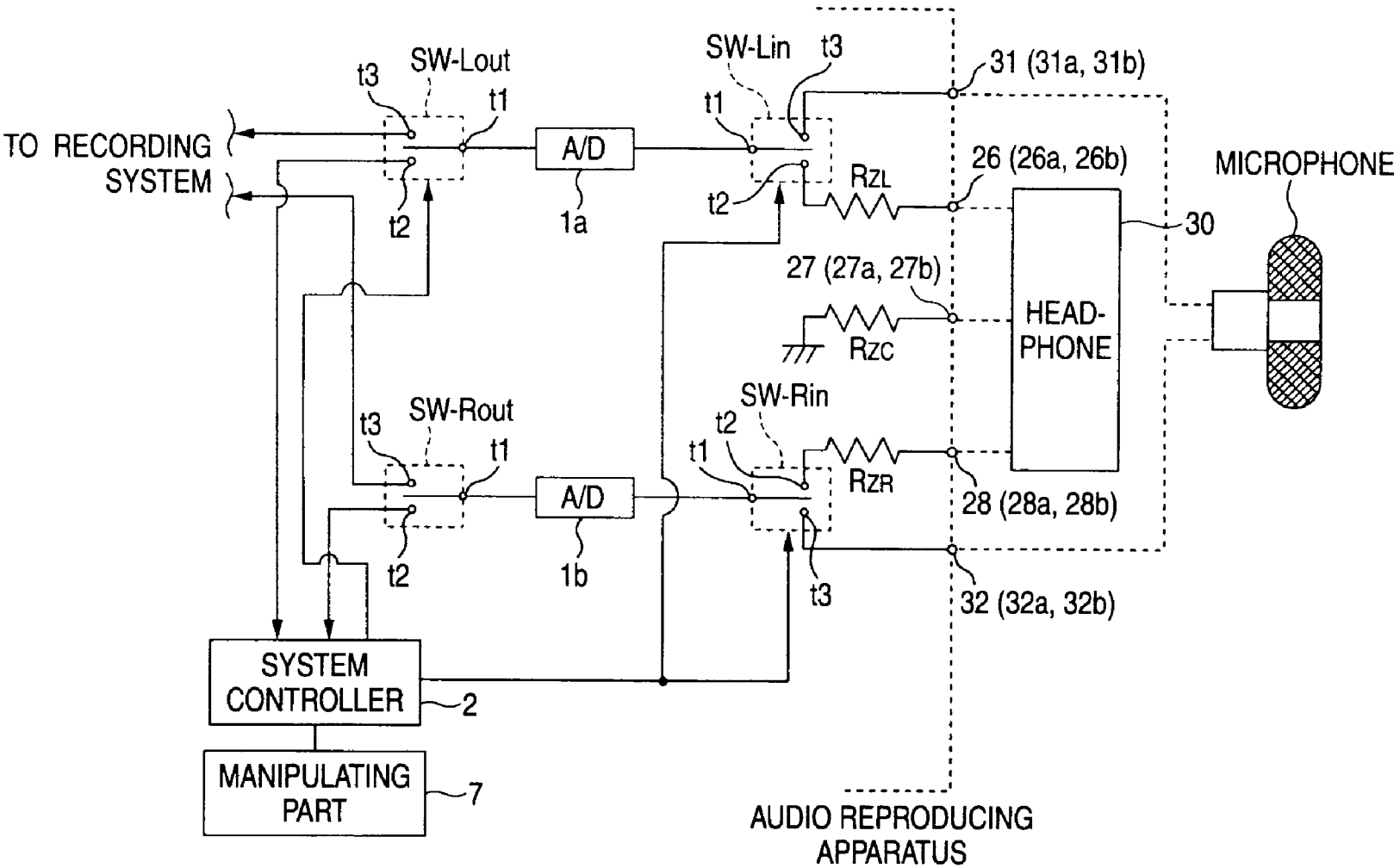
FIG. 5 shows a block diagram depicting the internal configuration of an audio reproducing apparatus according to a modification of the embodiment.

FIG. 5 shows a block diagram depicting an audio reproducing apparatus in which an A/D converter is shared as described above. FIG. 5 mainly extracts and shows the configuration that has to be added to the audio reproducing apparatus 100 shown in FIG. 4. In addition, in FIG. 5, the portions described in FIGS. 2 and 4 are designated the same numerals and signs, omitting the descriptions. First, the audio reproducing apparatus in this case has input terminals (an Lrec-in terminal 31*a* on the audio reproducing apparatus side, and a Rrec-in terminal 32*a* on the audio reproducing apparatus side), to which external audio signals can be inputted. For example, as shown in the drawing, to the terminals 31*a* and 32*a*, an L-terminal and an R-terminal of a microphone can be connected. In addition, in this case, the L-terminal on the microphone side is denoted as Lrec-in 31*b*, and the P-terminal on the microphone side is denoted as Rrec-in 32*b*.

In addition, in the audio reproducing apparatus in this case, a circuit for a recording system (not shown) is also provided which records audio data based on the inputs from the Lrec-in terminal 31*a* on the audio reproducing apparatus side and the Rrec-in terminal 32*a* on the audio reproducing apparatus side. The circuit for the recording system records supplied audio data on the memory part 3 shown in FIG. 4.

Then, as the configuration that has to be added to the audio reproducing apparatus 100 shown in FIG. 4, the audio reproducing apparatus in this case has a switch SW-Lin, a switch SW-Rin, a switch SW-Lout, and a switch SW-Rout, shown in the drawing.

Each of the switch SW-Lin, the switch SW-Rin, the switch SW-Lout, and the switch SW-Rout is a switch that can alternatively select a terminal t2 and a terminal t3 with respect to a terminal t1. First, in the switch SW-Lin, the terminal t3 is connected to the Lrec-in terminal 31*a* on the audio reproducing apparatus side. In addition, the terminal t2 of the switch SW-Lin is connected to the L-channel terminal 26*a* on the audio reproducing apparatus side through the resistance RZL. Then, the terminal t1 of the switch SW-Lin is connected to the A/D converter 1*a*. To the A/D converter 1*a*, the terminal t1 of the switch SW-Lout is connected. The output of the terminal t3 of the switch SW-Lout is supplied to the circuit for the recording system described above, and the output of the terminal t2 is supplied to the system controller 2.

In addition, the terminal t3 of the switch SW-Rin is connected to the Rrec-in terminal 32*a* on the audio reproducing apparatus side. Then, the terminal t2 of the switch SW-Rin is connected to the R-channel terminal 28*a* on the audio reproducing apparatus side through the resistance RZR. Furthermore, the terminal t1 of the switch SW-Rin is connected to the A/D converter lb. To the A/D converter 1*b*, the terminal t1 of the switch SW-Rout is connected. In addition, the output of the terminal t3 of the switch SW-Lout is supplied to the circuit for the recording system, and the output of the terminal t2 is supplied to the system controller 2.

In this case, in accordance with the time of recording input signals from the Lrec-in terminal 31*a* on the audio reproducing apparatus side and the Rrec-in terminal 32*a* on the audio reproducing apparatus side, the terminal t3 is selected with respect to the terminal t1 in the switch SW-Lin and the switch SW-Rin, under control done by the system controller 2. Thus, the A/D converters 1*a* and 1*b* convert the input audio signals into audio data. In addition, in association therewith, in recording, the terminal t3 is selected with respect to the terminal t1 in the switch SW-Lout and the switch SW-Rout, under control done by the system controller 2. Thus, the audio data can be supplied to the circuit for the recording system.

In addition, in accordance with the case in which the operation of reducing the sound leakage is performed for the sound leakage signals from the L-channel terminal 26*a* on the audio reproducing apparatus side and the R-channel terminal 28*a* on the audio reproducing apparatus side, the terminal t2 is selected with respect to the terminal t1 in the switch SW-Lin and the switch SW-Rin, under control done by the system controller 2. Thus, the A/D converters 1*a* and 1*b* can measure the voltages that occur in the resistance RZL and the resistance RZR as the amount of sound leakage. In addition, in association therewith, in measuring the sound leakage, the terminal t2 is selected with respect to the terminal t1 in the switch SW-Lout and the switch SW-Rout, under control done by the system controller 2. Thus, the amounts of sound leakage measured by the A/D converters 1*a* and 1*b* can be supplied to the system controller 2.

As described above, the switch SW-Lin, the switch SW-Lout, the switch SW-Rin, and the switch SW-Rout are provided to share the A/D converters 1*a* and 1*b* in recording and in measuring the sound leakage.

Since the recordable audio reproducing apparatus described above has the A/D converters in advance, it is unnecessary to newly provide A/D converters in measuring the amount of sound leakage, and it is sufficient that only the resistance RZL, the resistance RZR, the switch SW-Lin, the switch SW-Lout, the switch SW-Rin, and the switch SW-Rout are additionally provided. Since the A/D converters 1*a* and 1*b* are relatively expensive and the size is relatively large, the A/D converters 1*a* and 1*b* provided in advance are shared to suppress cost increases and it is also intended to prevent an increase in the mounting space for the circuit.

Here, in the audio reproducing apparatus 100 according to the embodiment shown in FIG. 4, in the case in which the process for reducing the sound leakage is started, a user makes a manipulating input to start the process for reducing the sound leakage by the manipulating part 7, and the system controller 2 starts the process for reducing the sound leakage based on the input information. Other than the scheme, this scheme may be done in which a detecting part such as a mechanical switch is provided to the connecting part of the terminals in the audio reproducing apparatus 100, it is determined whether the three terminals of the headphone 30 shown in FIG. 1 are connected, and the process is automatically started based on the detected results. In other words, it is configured in which at the connecting part at which the audio reproducing apparatus 100 according to the embodiment is connected to the headphone 30 through three terminals, the detecting part is provided on the connecting part on the audio reproducing apparatus 100 side, the three terminals in the headphone 30 are connected to the three terminals in the audio reproducing apparatus 100, and then the detecting part detects the connection of the terminals and supplies the detection signal to the system controller 2. In the system controller 2 in this case, it is determined whether the three terminals in the headphone 30 are connected to the three terminals in the audio reproducing apparatus 100 based on the detection signals from the detecting part. Then, if it is determined that they are connected to each other, the process for reducing the sound leakage is started.

In addition to the scheme of starting the process based on the detection signal from the detecting part as described above, this scheme may be done in which the process for reducing the sound leakage is started at the timing at which the power source is turned on.

In addition, in the discussion so far, the case is described in which the headphone 30 shown in FIG. 1 is directly connected to the audio reproducing apparatus 100 shown in FIG. 4. For example, the case can be considered in which the headphone 30 is not directly connected to the audio reproducing apparatus 100 as described below. For example, in recent years, a cellular telephone having an audio reproducing function is widely available. As described above, in the case in which the cellular telephone is used for audio reproduction, such a scheme is sometimes done in which the headphone 30 is not directly connected to the headphone jack of the cellular telephone and it is connected to an audio output unit that allows data communications with the cellular telephone by radio communications such as Bluetooth. In other words, in this case, audio data reproduced from the cellular telephone is sent to the output unit by radio, and then outputted from the headphone 30 connected to the output unit. With this audio reproduction form, for example, this scheme may be possible in which a user keeps the cellular telephone in a bag and carries only a relatively small output unit within the range in which the headphone can be mounted. Then, also in the case of this audio reproduction form, in the case in which the output unit is connected to the headphone 30 through three terminals, it is likely that the similar sound leakage occurs as that described above. Also in this case, when it is intended to reduce the sound leakage, the control part (for example, a microcomputer) of the cellular telephone main body performs the similar process for reducing the sound leakage as that described above. However, in this case, the A/D converters 1*a* and 1*b* (measuring modules) which measure the amount of sound leakage are provided so as to detect the voltages at both ends of the resistances disposed before the L-channel and R-channel output terminals (corresponding to the resistance RZL and the resistance RZR) in the output unit. In addition, the reference signal to be outputted for measurement is sent to the output unit through a radio communicating part such as Bluetooth for output. In addition, as similar to the specific examples described above, it is sufficient that the coefficient in accordance with the sound leakage ratio is set to the sound leakage reducing multipliers 9*a* and 9*b* and the overflow preventing multipliers 8*a* and 8*b* in the D-Block 6 disposed on the main body side. Therefore, audio data after the process for reducing the sound leakage can be supplied to the output unit, and it can be intended to reduce the sound leakage as similar to the cases described in the specific examples.

In addition, in the embodiment, the reference signal that measures the amount of sound leakage is stored in the system controller 2 as 1 kHz of a sinusoidal wave signal. However, the reference signal may be signals other than 1 kHz of a sinusoidal wave signal. In addition, the place to store the reference signal is not restricted to the system controller 2, but may be other place such as in the memory part 3. Furthermore, the reference signal may be generated any time by a signal generator, not stored in advance.

In addition, in the embodiment, an example is described in which the reference signal is carried through the L-channel and then carried through the R-channel to perform the process for reducing the sound leakage. This order may be reversed to carry the reference signal through the R-channel and then through the L-channel to perform the process for reducing the sound leakage.

In addition, in the embodiment, an example is described in which the reference signal is in turn carried through the L-channel and the R-channel to perform the process for reducing the sound leakage. The reference signal may be carried through the L-channel and the R-channel at the same time to perform the process for reducing the sound leakage. In this case, it is sufficient that the frequency of the reference signal to be carried through the L-channel and the R-channel is different frequencies. For example, suppose the L-channel reference signal is 100 Hz, the R-channel reference signal is 1 kHz, and the signals are carried at the same time. At this time, on the L-channel side, such a signal can be obtained that a reference signal (a frequency of 100 Hz) carried through the L-channel is superimposed with a sound leakage signal (a frequency of 1 kHz) from the R-channel. Then, for example, a frequency separator is used to extract (separate) only the sound leakage signal (a frequency of 1 kHz) from the R-channel, and the signal is used as an amount of sound leakage for the L-channel. In addition, similarly, on the R-channel side, such a signal can be obtained that a reference signal (a frequency of 1 kHz) carried through the R-channel is superimposed with a sound leakage signal (a frequency of 100 Hz) from the L-channel. Thus, it is sufficient that only the sound leakage signal (a frequency of 100 Hz) from the L-channel is extracted (separated) to use as an amount of sound leakage in the R-channel. For example, as described above, the frequency of the reference signal to be carried through the L-channel and the R-channel is different frequencies, whereby the amounts of sound leakage can be properly measured even tough the reference signals are carried through the L-channel and the R-channel at the same time.

In addition, in the audio reproducing apparatus 100 shown in FIG. 4, the sound leakage ratio is in turn computed in the L-channel and the R-channel. However, this scheme may be done in which only a sound leakage ratio of one of the L-channel and the R-channel is computed, the sound leakage ratio is set to the representative value, and the value is set to the sound leakage ratio of the other channel. In other words, the reference signal is carried through only one of the channels, the sound leakage signal actually generated in the other channel is measured as the amount of sound leakage, and the sound leakage ratio is computed. The computed sound leakage ratio is set to the representative value, and the value is adopted as the sound leakage ratio for the channel through which the reference signal is not carried and the sound leakage ratio is not actually computed.

In addition, this scheme may be done in which after the representative value as described above is set, the sound leakage ratio is again set in the channel to which the representative value is set. In other words, in the channel to which the representative value is set, the sound leakage ratio is computed based on the sound leakage signal actually measured, and the difference from the sound leakage ratio that is set as the representative value is filled to again set the sound leakage ratio.

It should be understood by those skilled in the art that various modifications, combinations, sub-combinations and alterations may occur depending on design requirements and other factors insofar as they are within the scope of the appended claims or the equivalents thereof.

What is claimed is:

1. A reproducing apparatus connected to a second apparatus being an audio signal output apparatus and including a three pole terminal, the three pole terminal having a first input terminal for a first channel audio signal, a second input terminal for a second channel audio signal, and a ground terminal shared by the first channel audio signal and the second channel audio signal, the second apparatus further including a first output unit, which is connected to the input terminal for the first channel audio signal and, which outputs the first channel audio signal, and a second output unit, which is connected to the input terminal for the second channel audio signal and, which outputs the second channel audio signal, the reproducing apparatus comprising:

a connecting part which is connected to the second apparatus through the three pole terminal;

a storage part which stores audio content data including first channel audio data and second channel audio data;

a reproducing part which reproduces the audio content data;

a first converting part which converts the first channel audio data included in the audio content data reproduced by the reproducing part into the first channel audio signal;

a second converting part which converts the second channel audio data included in the audio content data reproduced by the reproducing part into the second channel audio signal; and a measuring part which measures at least any one of: an amount of sound leakage in the second output unit resulting from output, by the first output unit, of the first channel audio signal and, an amount of sound leakage in the first output unit resulting from output, by the second output unit, of the second channel audio signal.

2. The reproducing apparatus according to claim 1, further comprising:

a control part which performs, as a process of automatically adjusting sound leakage reduction, at least any one of:

a process in which the first channel audio data is combined with second reduced audio data such that the second channel audio data is reduced based on the measured result of the measuring part, and a process in which the second channel audio data is combined with first reduced audio data such that the first channel audio signal is reduced based on the measured result of the measuring part.

3. The reproducing apparatus according to claim 1, wherein the measuring part comprises:

an A/D converter configured to:

receive a first audio signal, obtained at an output terminal of the connecting part designated for the first channel audio signal, or receive a second audio signal, obtained at an output terminal of the connecting part designated for the second channel audio signal, and wherein an amount of sound leakage in the second output unit or an amount of sound leakage in the first output unit is measured by the A/D converter.

4. The reproducing apparatus according to claim 3, further comprising:

an input terminal which externally receives an audio signal, wherein the A/D converter in the measuring part is configured to receive an audio signal from the input terminal.

5. The reproducing apparatus according to claim 2, wherein the control part performs the process of automatically adjusting sound leakage reduction based on a predetermined instruction.

6. The reproducing apparatus according to claim 2, wherein the control part performs the process of automatically adjusting sound leakage reduction in response to a power source being turned on.

7. The reproducing apparatus according to claim 2, further comprising:

a connection detecting part which detects a connection of the three pole terminal to the connecting part, wherein the control part performs the process of automatically adjusting sound leakage reduction based on the detected result of the connection detecting part.

8. The reproducing apparatus according to claim 2, wherein the control part performs, as the process of automatically adjusting sound leakage reduction, at least one of:

a process in which audio data is supplied to the first converting part, an audio signal, based on the audio data, is outputted from the first output unit, an amount of sound leakage in the second output unit is acquired by the measuring part, and the first channel audio data is added with second reduced audio data such that the second channel audio data is reduced based on the acquired amount of sound leakage, and a process in which the audio data is supplied to the second converting part, an audio signal based on the audio data is outputted from the second output unit, an amount of sound leakage in the first output unit is acquired by the measuring part, and the second channel audio data is added with first reduced audio data such that the first channel audio data is reduced based on the acquired amount of sound leakage.

9. A reproducing method of reproducing an audio signal implemented by a reproducing apparatus connected to a second apparatus being an audio signal output apparatus and including a three pole terminal, the three pole terminal having a first input terminal for a first channel audio signal, a second input terminal for a second channel audio signal, and a ground terminal shared by the first channel audio signal and the second channel audio signal, the second apparatus further including a first output unit, which is connected to the input terminal for the first channel audio signal and, which outputs the first channel audio signal, and a second output unit, which is connected to the input terminal for the second channel audio signal and, which outputs the second channel audio signal, the method comprising the steps of:

reproducing content data by a reproducing part;

performing first conversion in which a first converting part converts the first channel audio data included in the content data reproduced by the reproducing part into the first channel audio signal;

performing second conversion in which a second converting part converts the second channel audio data included in the content data reproduced by the reproducing part into the second channel audio signal; and measuring at least any one of: an amount of sound leakage in the second output unit resulting from output, by the first output unit, of the first channel audio signal and, an amount of sound leakage in the first output unit resulting from output, by the second output unit, of the second channel audio signal.

* * * * *